US006875028B2

(12) United States Patent
Kita et al.

(10) Patent No.: US 6,875,028 B2
(45) Date of Patent: Apr. 5, 2005

(54) ELECTRICAL CONNECTION BOX

(75) Inventors: Yukinori Kita, Yokkaichi (JP); Tatsuya Oka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/464,452

(22) Filed: Jun. 19, 2003

(65) Prior Publication Data

US 2003/0236008 A1 Dec. 25, 2003

(30) Foreign Application Priority Data

Jun. 21, 2002 (JP) ..... 2002-181658

(51) Int. Cl.[7] ..... H01R 12/00
(52) U.S. Cl. ..... 439/76.2; 439/621
(58) Field of Search ..... 439/76.2, 441, 439/835, 621, 622, 923, 374, 485, 949

(56) References Cited

U.S. PATENT DOCUMENTS 5,145,414 A * 9/1992 Oikawa ..... 439/621
5,277,626 A 1/1994 Oikawa et al.
5,285,011 A * 2/1994 Shimochi ..... 174/52.1
5,662,496 A 9/1997 Kanamori
5,980,306 A * 11/1999 Tanaka et al. ..... 439/485
6,585,541 B2 * 7/2003 Higashida et al. ..... 439/622
6,608,546 B2 * 8/2003 Andoh et al. ..... 337/260

FOREIGN PATENT DOCUMENTS

JP 9-135087 5/1997
JP 2000-270442 9/2000

OTHER PUBLICATIONS

English Language Abstract of JP 9–135087.
English Language Abstract of JP 2000–270442.

* cited by examiner

*Primary Examiner*—Gary Paumen
*Assistant Examiner*—Edwin A. Leon
(74) *Attorney, Agent, or Firm*—Greenblum & Bernstein, P.L.C.

(57) ABSTRACT

An electrical connection box allows an electrical component mounted in a mounting housing in a rear row to be removed easily from a front side thereof. A plurality of mounting housings are arranged in rows in a central part of a mounting surface of an upper case, with a first plurality of mounting housings provided in a front row and a second plurality of mounting housings provided in a rear row. The mounting housings in the front row are arranged in a lateral direction, with a predetermined interval provided between the adjacent mounting housings. Thus a gap is formed between the adjacent mounting housings arranged in the front row. Through the gap, the tip of a jig may be inserted between the mounting housings in the rear row.

10 Claims, 5 Drawing Sheets

ELECTRICAL CONNECTION BOX

BACKGROUND OF THE INVENTION

1. Field of the Invention

The present invention relates to an electrical connection box for use in vehicles such as automobiles.

2. Description of Related Art

As shown in FIGS. 7 and 8, in a body 52 of an electrical connection box 50, a plurality of mounting housings 54*a* and 54*b* are arranged in a front row and a rear row, respectively. A relay 51 is removably mounted in each of the mounting housings 54*a* and 54*b*. To perform maintenance on the electrical connection box 50, a failed relay 51 is removed from the mounting housings 54*a* and 54*b* and replaced with a new relay 51. In this case, through a cut-out portion 55 formed on a side wall of the mounting housings 54*a* and 54*b*, the tip of a screwdriver is inserted into the gap between the relay 51 and a mounting surface of an upper case 53 forming the body 52. Then the relay 51 is moved upward from the mounting surface of the upper case 53 and the relay 51 is pulled out from the mounting housing by grasping the relay 51 by hand.

The mounting housings 54*a* disposed in the front row and the mounting housings 54*b* disposed in the rear row confront each other in a front-to-rear direction. Therefore, the relay 51 mounted on the mounting housing 54*a* in the front row interferes with the removal of the relay 51 from the mounting housing 54*b* in the rear row. Normally, a component is mounted in the rear mounting housing 54*b*, so a vacant space is seldom left at the rear mounting housing 54*b*. As such, it is necessary to remove the relay 51 in the mounting housing 54*a* disposed in the front row to form an open space in front of the mounting housing 54*b* disposed in the rear row. As described above, in the conventional electrical connection box, it is very difficult to remove the relay 51 from the mounting housing 54*b* disposed in the rear row.

SUMMARY OF THE INVENTION

The present invention has been created in view of the above-described problems. Accordingly, it is an object of the present invention to provide an electrical connection box that allows an electrical component mounted in a mounting housing thereof in a rear row to be removed easily from the front side thereof.

In the present invention, there is provided an electrical connection box including a plurality of mounting housings on which electrical components are removably mounted, wherein a plurality of first mounting housings are arranged in a row; a plurality of second mounting housings are arranged in a row near the row of the first mounting housings; and a gap adjacent a cutaway portion in each of the second mounting housings is formed between adjacent first mounting housings to allow a jig for pulling out an electrical component to be inserted between the electrical component and the body through the gap and the cutaway portion.

According to this construction, to remove the electrical component from one of the second mounting housings disposed in a rear row, the jig is inserted into the gap between the first mounting housings disposed in the front row, and the tip of the jig is inserted between the electrical component mounted in one of the second mounting housings disposed in the rear row and the body of the electrical connection box. Then by operating the jig, the electrical component mounted in one of the second mounting housings is moved upward from a mounting surface of the body of the electrical connection box. In this state, the electrical component is pulled out of the one of the second mounting housings disposed in the rear row. Thus in removing the electrical component mounted in the one of the second mounting housings disposed in the rear row, it is unnecessary to remove the electrical component mounted in one of the first mounting housings disposed in the front row. Therefore it is easy to perform an electrical component removal operation.

The present invention includes a projection element serving as a fulcrum in rotation of the jig that is formed near the first mounting housings.

According to this construction, the jig is brought into contact with the projection element. Thereafter the jig is rotated around the point of contact between the jig and the projection element. As a result, owing to the principle of the lever, it is possible to move the electrical component mounted in one of the second mounting housings upward from the mounting surface of the body of the electrical connection box. That is, with a small force, it is possible to move the electrical component upward from the mounting surface thereof and easily remove the electrical component from one of the second mounting housings disposed in the rear row. Additionally, a projection member may be provided in the gap.

According to this construction, the projection element serving as the fulcrum in the rotation of the jig is provided near the electrical component mounted on one of the second mounting housings. Therefore with a small force, it is possible to move the electrical component upward from the mounting surface of the body of the electrical connection box.

An aspect of the present invention provides an electrical connection box having a component mounting surface, the electrical connection box including a plurality of first mounting housings to removably mount electrical components therein, the plurality of first mounting housings provided adjacent to each other on the surface and arranged in a front row; a plurality of second mounting housings to removably mount electrical components therein, the plurality of second mounting housings provided adjacent to each other on the surface and arranged in a rear row proximate the front row; each of the second mounting housings including a cutaway portion in a front wall thereof; and a gap provided between each of the first mounting housings in the front row and in front of one of the cutaway portions; wherein each gap allows a jig to be inserted between an electrical component in the rear row and the surface to remove the electrical component. The electrical connection box of the present invention may also include a projection element provided adjacent the first mounting housings; wherein the projection element operates as a fulcrum for the jig. Further, the projection element may include a projection member in each gap. The projection element may be provided on the surface in front of the front row of the first mounting housings; and may be configured as an elongated bar extending along the front row of the first mounting housings.

According to a further aspect of the present invention, the front row is substantially parallel to the rear row and the first mounting housings in the front row are staggered relative to the second mounting housings in the rear row so that each cutaway portion is positioned at the end of a straight line extending from a corresponding one of the gaps toward a rear side of the electrical connection box and allows a jig to be inserted between adjacent first mounting housings and between an electrical component and the surface to remove the electrical component. Further, the width of each gap is substantially equal to the width of the jig.

According to a further aspect of the present invention, the electrical connection box further includes a cutaway portion formed in a rear wall of each of the first mounting housings; and a gap provided between each of the second mounting housings in the rear row behind each of the cutaway portions in the first mounting housings; wherein each gap between the second mounting housings allows a jig to be inserted between an electrical component and the surface to remove the electrical component. Additionally, the front row may be substantially parallel to the rear row and the first mounting housings in the front row are staggered relative to the second mounting housings in the rear row so that each cutaway portion in the first mounting housings is positioned at the end of a straight line extending from a corresponding one of the gaps between the second mounting housings toward a front side of the electrical connection box and allows a jig to be inserted between adjacent second mounting housings and between an electrical component and the surface to remove the electrical component. Further, the electrical connection box may include at least one additional row of mounting housings, including a plurality of additional mounting housings to removably mount electrical components therein and provided adjacent to each other on the surface and arranged in the at least one additional row behind the rear row; and each of the additional mounting housings including a cutaway portion in a front wall thereof.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

An embodiment of the present invention will be described below with reference to the drawings.

Figure 1:
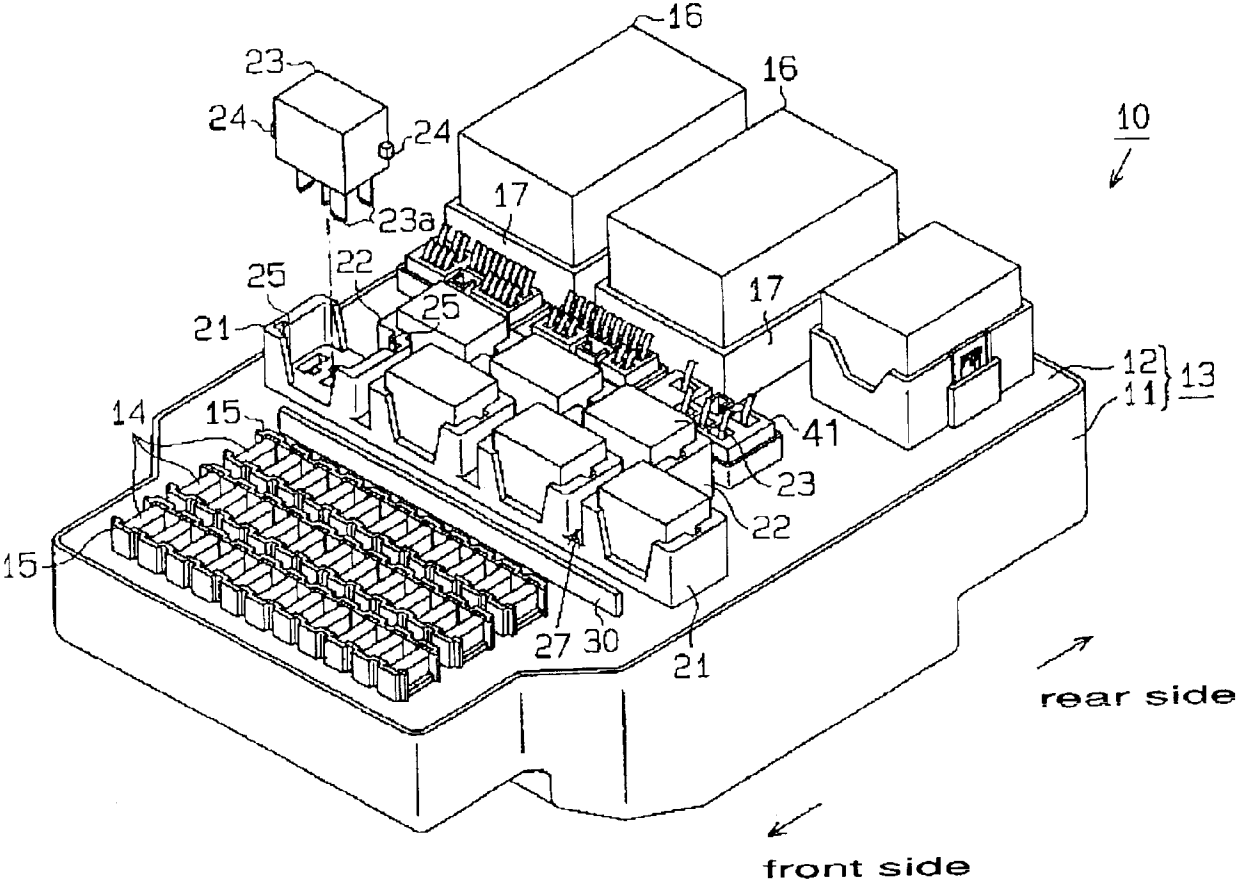
FIG. 1 is a perspective view showing an electrical connection box according to a first embodiment of the present invention.
Figure 2:
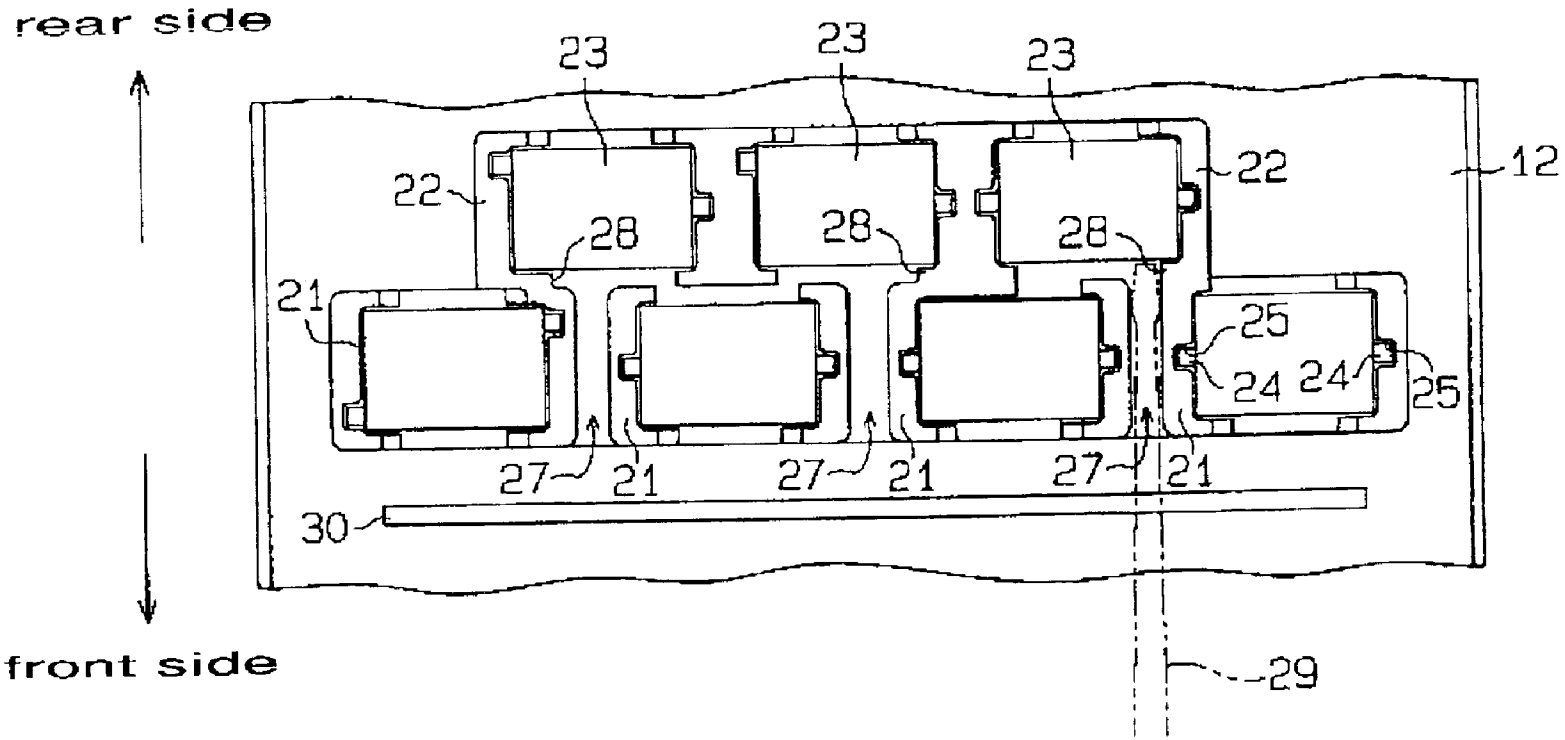
FIG. 2 is a partially cutaway plan view of the electrical connection box of FIG. 1.
Figure 3:
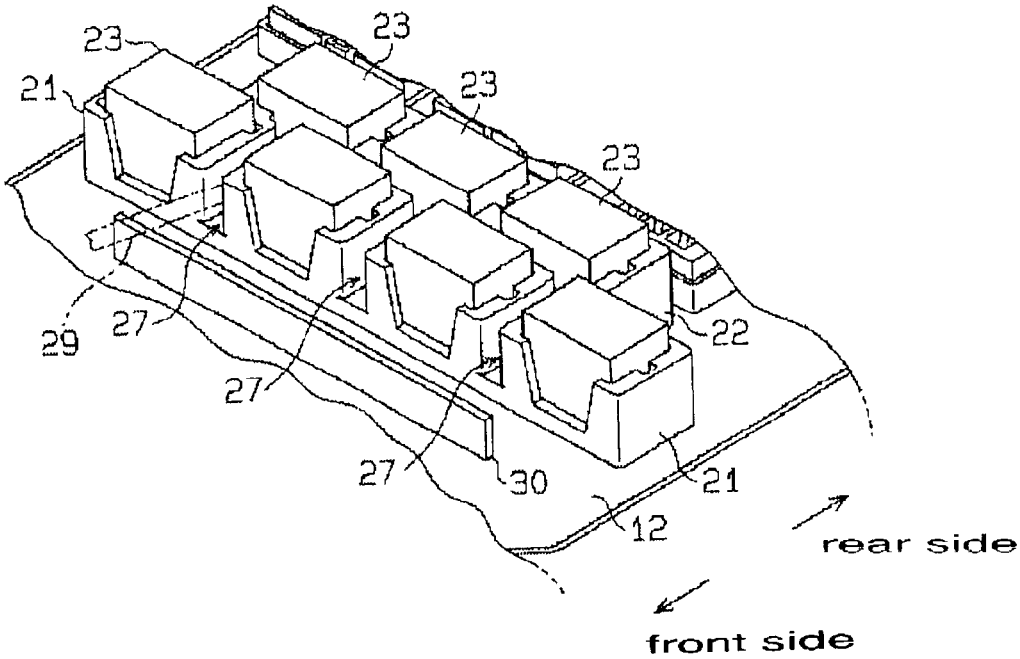
FIG. 3 is a perspective view showing the main portions of the electrical connection box of FIG. 1.

As shown in FIGS. 1 and 2, a body 13 of an electrical connection box 10 includes a lower case 11, and an upper case 12 mounted on the lower case 11 so as to close an open portion of the lower case 11. The upper case 12 and lower case 11 may be constructed of any suitable material such as, for example, synthetic resin. Fuses 14 are removably mounted on a mounting surface of the upper case 12 on one side thereof by fuse-mounting housings 15. Connectors 16 are removably mounted on the mounting surface of the upper case 12 at another side thereof by connector-mounting housings 17.

Mounting housings 21 and 22 are arranged in rows in the central part of the mounting surface of the upper case 12, with a plurality of first mounting housings 21 provided in a front row and a plurality of second mounting housings 22 provided in a rear row. A relay 23 serving as an electrical component is removably mounted on each of the mounting housings 21 and 22. A connection terminal 23*a* projecting from a lower surface of the relay 23 is connected to a terminal (not shown) mounted at a position corresponding to the position of each of the mounting housings 21 and 22.

As shown in FIGS. 1 through 4, engaging projections 24 are formed on both side surfaces of each relay 23. In the condition in which a relay 23 is mounted in each of the mounting housings 21 and 22, the engaging projections 24 on the relay 23 engage recessed grooves 25 formed on opposed inner surfaces of each of the mounting housings 21 and 22. The recessed grooves 25 prevent incorrect insertion of the relays 23 in the mounting housings 21, 22. The position of the engaging projections 24 are different depending on the type of relay 23. The position of the recessed grooves 25 are different depending on the type of relay 23 (and therefore the position of the engaging projections 24) to be mounted on the mounting housings 21 and 22.

The plurality of second mounting housings 22 in the rear row are provided near the connectors 41 and adjacent to each other without a gap between the mounting housings 22. The adjacent mounting housings 22 together share a side surface thereof on the boundary between the mounting housings 22 and the connectors 41. The plurality of first mounting housings 21 in the front row are arranged near the fuses 14, and a predetermined interval in a lateral direction is provided between the adjacent mounting housings 21. In this arrangement, a gap 27 is formed between the adjacent mounting housings 21 arranged in the front row.

The mounting housings 22 in the rear row and the mounting housings 21 in the front row are shifted relative to each other so that the mounting housings 22 and the mounting housings 21 are positioned in a staggered arrangement offset from each other, and together the front and rear row produce a zigzag line of mounting housings 21, 22 and relays 23. By this staggered arrangement, a cutaway portion 28 formed in the front side wall of the mounting housing 22 in the rear row is positioned at the end of a straight line extending from the gap 27 formed between the adjacent mounting housings 21 in the front row toward the rear side of the electrical connection box 10, as shown particularly in FIG. 2. Therefore, through the gap 27 and the cutaway portion 28, the tip of a jig 29 such as a screwdriver, shown in FIG. 2, may be inserted between the mounting housings 21 in the front row. The width of the gap 27 formed between the adjacent mounting housings 21 arranged in the front row is set equal to that of the jig 29 to prevent the jig 29 from moving in the lateral direction of the mounting housings 21 in the front row, when the jig 29 is inserted into the gap 27. Thereby it is easy to perform the operation of removing a relay from a mounting housing 22 in the rear row.

Although not shown, the gap 27 into which the jig 29 is inserted may be formed not only between the adjacent mounting housings 21 in the front row. For example, in FIGS. 1 and 2, by swapping the position of the components of the connection box, the connectors 16, 41 may be provided in front of the mounting housings 21 arranged in the front row, and the fuses 14 may provided at the rear side of the mounting housings 22 arranged in the rear row. In this case, gaps similar to the gaps 27 between the adjacent mounting housing 21 in the front row may be formed between the adjacent mounting housings 22 in the rear row. Thus, the configuration is reversible and relays may be removed easily from mounting housings in either row. Alternatively, gaps may be formed only between the mounting housings 22 in the rear row.

On the mounting surface of the body 13 of the electrical connection box, an elongated projection 30 extending in the lateral direction of the mounting housings 21, 22 is positioned in the space between the fuses 14 and the mounting housings 21, 22. The elongated projection 30 may be of any suitable shape such as, for example, rail shaped or bar shaped. The projection element 30 serves as the fulcrum in the rotational lever action of the jig 29 inserted into the gap 27.

Figure 4:
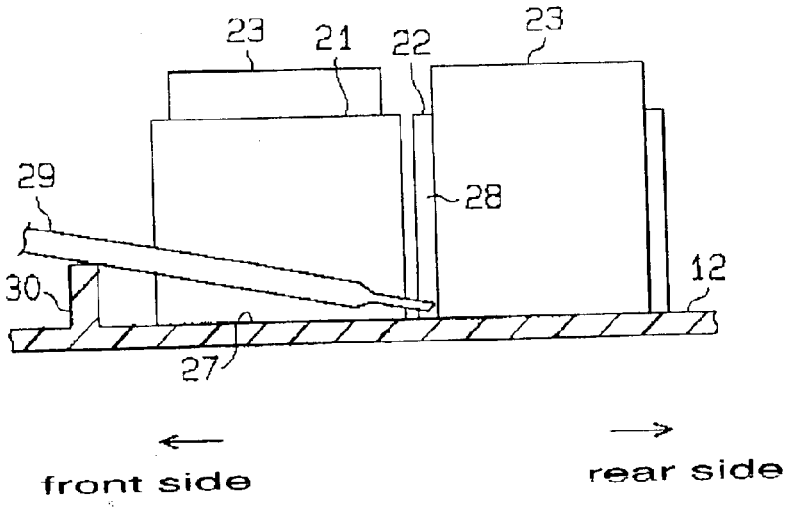
FIG. 4 is a sectional view showing the electrical connection box of FIG. 1 viewed from a side of a mounting housing when a relay is pulled out of the mounting housing.

To remove the relay 23 from the mounting housing 22 disposed in the rear row in the electrical connection box 10 having the above-described construction, the jig 29 is inserted into the gap 27 corresponding to the relay 23 to be removed, as shown in FIG. 4. The tip of the jig 29 is inserted into the gap between the relay 23 and the mounting surface of the upper case 12. Then the jig 29 is brought into contact with the upper end of the projection element 30. Thereafter the jig 29 is rotated on the point of contact between the jig 29 and the projection element 30. As a result, the relay 23 is moved upward from the mounting surface of the upper case 12. Then the relay 23 may be grasped with an operator's hand or grasping tool and removed from the mounting housing 22 in the rear row.

As described above, in the first embodiment, the mounting housings 22 in the rear row are staggered relative to the mounting housings 21 in the front row. Thus the tip of the jig 29 can be inserted between the relay 23 in the rear row and the mounting surface of the upper case 12 through the gap 27 formed between the adjacent mounting housings 21 in the front row. This construction eliminates the need for removing the relay 23 in the front row and facilitates the operation of removing the relay 23 in the rear row. The construction of the first embodiment is applicable to a fuse mounting portion of the upper case 12 and to a connector mounting portion of the upper case 12.

The substantially bar shaped projection 30 stands upright near the mounting housings 21 in the front row. Thus, in removing the relay 23 from the mounting housing 22 in the rear row, the jig 29 can be rotated on the projection element 30 with the projection element 30 serving as the fulcrum of a lever. Thus with a small force, the relay 23 in the rear row can be moved upward from the mounting surface of the upper case 12. That is, the operation of removing a relay can be performed very easily.

Further, the gap 27 formed between the adjacent mounting housings 21 arranged in the front row is set equal to the jig 29 width. Therefore, it is possible to prevent the jig 29 from moving in the lateral direction of the mounting housings 21 in the front row, when the jig 29 is inserted into the gap 27. Thereby it is easy to perform an operation for exchanging the relay 23 even if the electrical connection box 10 is mounted in a position where it is difficult to maneuver, such as a corner of the inside of a vehicle.

Figure 5:
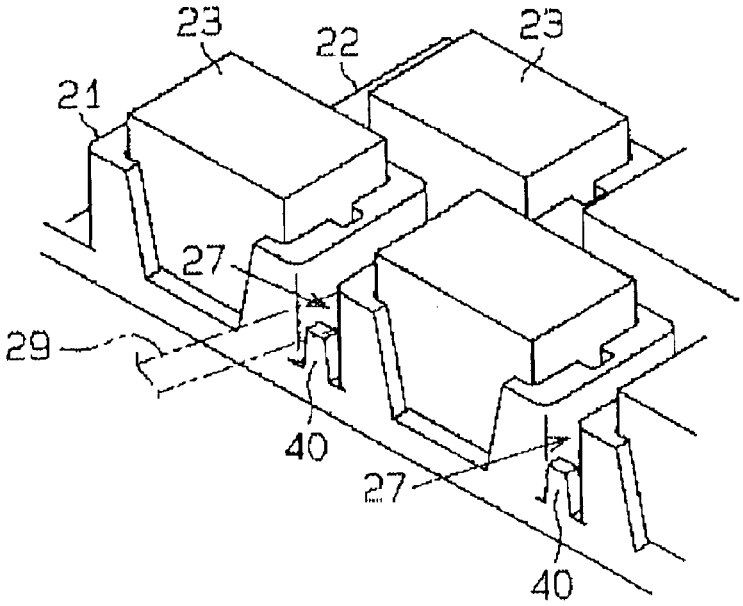
FIG. 5 is a perspective view showing a portion of an electric connection box according to a second embodiment of the present invention.
Figure 6:
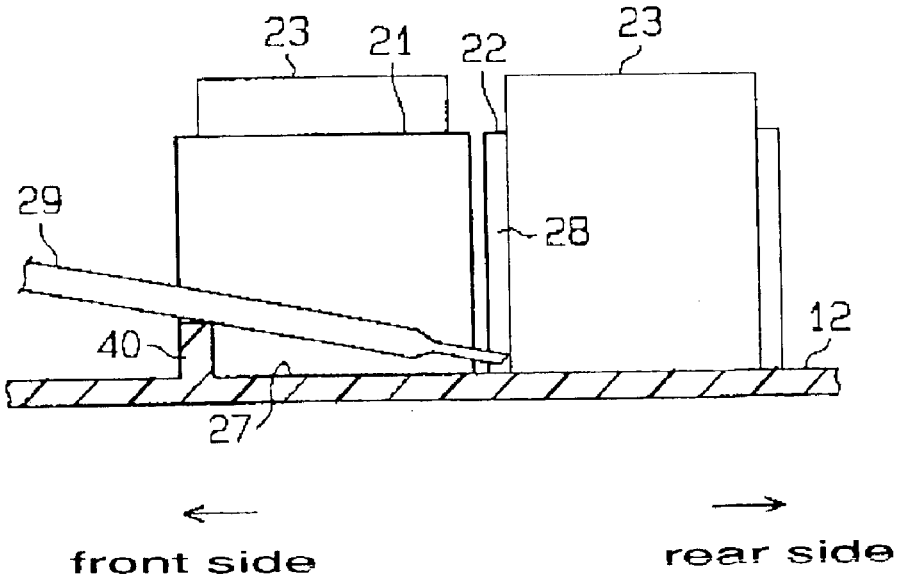
FIG. 6 is a sectional view showing the electric connection box of FIG. 5 viewed from a side of a mounting housing when the relay is pulled out of the mounting housing.
Figure 7:
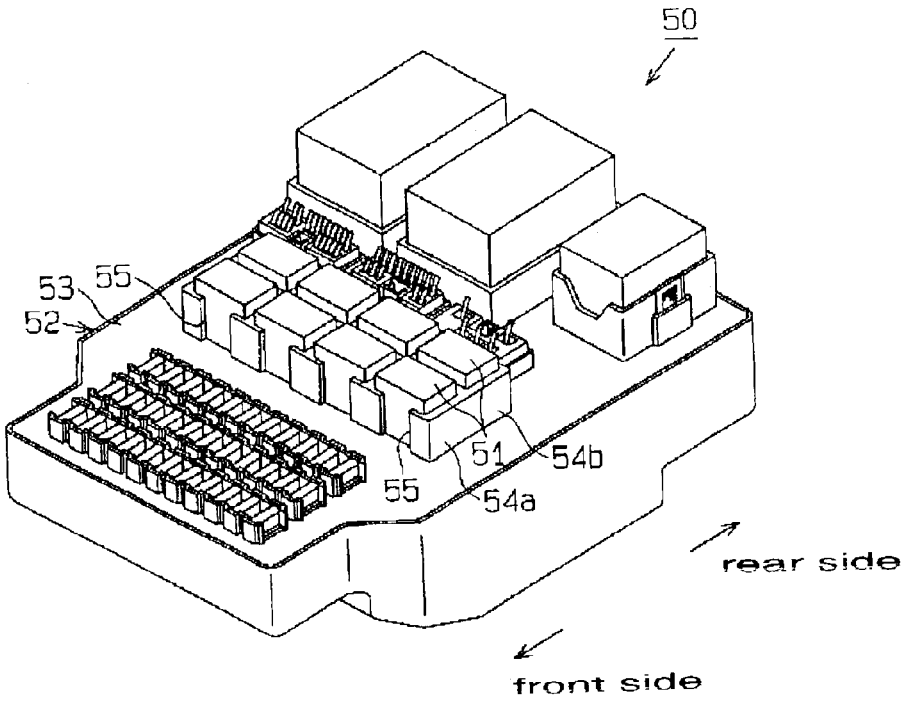
Figure 7 Prior Art
FIG. 7 is a perspective view showing a conventional electrical connection box.
Figure 8:
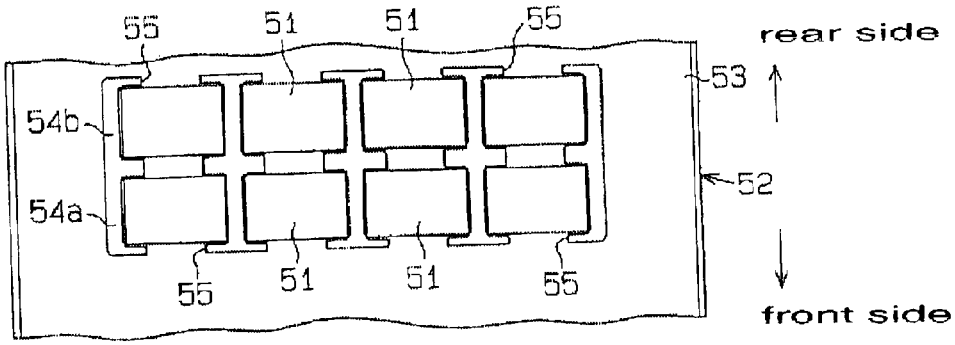
Figure 8 Prior Art
FIG. 8 is a partially cutaway plan view of the conventional electric connection box of FIG. 7.

The projection element 30 shown in the first embodiment can be altered, as described below. That is, as shown in FIGS. 5 and 6, a small projection member 40 serving as the fulcrum in the rotation of the jig 29 may project into the gap 27 between the adjacent mounting housings 21 arranged in the front row. Consequently, the projection member 40 is near to the relay 23 in the rear row. Thus the force application point (i.e., the location of the operator's hand at the end of the jig) is located farther from the fulcrum. Therefore, in removing the relay 23 in the rear row, the force required to rotate the jig 29 in the second embodiment can be smaller than that in the first embodiment. Accordingly, the relay 23 in the rear row can be removed more easily. Further, since the projection member 40 is disposed in the gap 27 formed between the adjacent mounting housings 21 arranged in the front row, it is unnecessary to provide the mounting surface of the upper case 12 with a space for positioning the projection member 40. Thus it is possible to make the body 13 of the electrical connection box even more compact.

According to the present invention, the jig is inserted into the gap between the mounting housings provided in the front row, and the jig is inserted between the electrical component mounted in one of the mounting housings provided in the rear row and the body of the electrical connection box. Thereby the electrical component mounted in one of the mounting housings in the rear row can be removed therefrom.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. JP 2002-181658, filed on Jun. 21, 2003, which is herein expressly incorporated by reference in its entirety.

What is claimed is:

1. An electrical connection box having a component mounting surface, said electrical connection box comprising:

a plurality of first mounting housings to removably mount electrical components therein, said plurality of first mounting housings provided adjacent to each other on said surface and arranged in a front row;

a plurality of second mounting housings to removably mount electrical components therein, said plurality of second mounting housings provided adjacent to each other on said surface and arranged in a rear row proximate said front row;

each of said second mounting housings including a cutaway portion in a front wall thereof; and a gap provided between each of said first mounting housings in said front row and in front of one of said cutaway portions;

wherein each said gap allows a jig to be inserted between an electrical component in said rear row and said surface to remove the electrical component;

wherein said front row is substantially parallel to said rear row and said first mounting housings in said front row are staggered relative to said second mounting housings in said rear row so that each said cutaway portion is positioned at the end of a straight line extending from a corresponding one of said gaps toward a rear side of said electrical connection box and allows a jig to be inserted between adjacent first mounting housings and between an electrical component and said surface to remove the electrical component.

2. The electrical connection box according to claim 1, wherein the width of each said gap is substantially equal to the width of the jig.

3. The electrical connection box according to claim 1, further comprising:

at least one additional row of mounting housings, said at least one additional row including a plurality of additional mounting housings to removably mount electrical components therein, said plurality of additional mounting housings provided adjacent to each other on said surface and arranged in said at least one additional row behind said rear row; and each of said additional mounting housings including a cutaway portion in a front wall thereof.

4. The electrical connection box according to claim 1, further comprising:

a projection element provided adjacent said first mounting housings;

wherein said projection element operates as a fulcrum for the jig.

5. The electrical connection box according to claim 4, wherein said projection element comprises a projection member in each said gap.

6. The electrical connection box according to claim 4, wherein said projection element is provided on said surface in front of said front row of said first mounting housings.

7. The electrical connection box according to claim 6, wherein said projection element is configured as an elongated bar extending along said front row of said first mounting housings.

8. The electrical connection box according to claim 1, further comprising:

a cutaway portion formed in a rear wall of each of said first mounting housings; and a gap provided between each of said second mounting housings in the rear row behind each of said cutaway portions in said first mounting housings;

wherein each said gap between said second mounting housings allows a jig to be inserted between an electrical component and said surface to remove the electrical component.

9. The electrical connection box according to claim 8, wherein said front row is substantially parallel to said rear row and said first mounting housings in said front row are staggered relative to said second mounting housings in said rear row so that each said cutaway portion in said first mounting housings is positioned at the end of a straight line extending from a corresponding one of said gaps between said second mounting housings toward a front side of said electrical connection box and allows a jig to be inserted between adjacent second mounting housings and between an electrical component and said surface to remove the electrical component.

10. The electrical connection box according to claim 8, wherein the width of each said gap between said second mounting housings is substantially equal to the width of the jig.

* * * * *